United States Patent [19]

Wachs

[11] Patent Number: 4,475,832

[45] Date of Patent: Oct. 9, 1984

[54] PARALLEL GUIDE FOR PUSH-BUTTON SWITCHES WITH MULTIPLE BUTTONS

[75] Inventor: Walter Wachs, Krailling, Fed. Rep. of Germany

[73] Assignee: Siemens Aktiengesellschaft, Berlin & Munich, Fed. Rep. of Germany

[21] Appl. No.: 496,339

[22] Filed: May 24, 1983

Related U.S. Application Data

[63] Continuation of Ser. No. 285,627, Jul. 21, 1981, abandoned.

[30] Foreign Application Priority Data

Aug. 27, 1980 [DE] Fed. Rep. of Germany ..... 3032282

[51] Int. Cl.[3] ..... B41J 5/12

[52] U.S. Cl. ..... 400/496; 400/495

[58] Field of Search ..... 400/479, 479.1, 479.2, 400/480, 481, 485, 496, 495.1, 495

[56] References Cited

U.S. PATENT DOCUMENTS

| | | | |
|---|---|---|---|
| 3,711,685 | 1/1973 | Castle | 400/479 X |
| 3,720,801 | 3/1973 | Yanaga | 400/496 X |
| 4,188,136 | 2/1980 | Bedocs | 400/479 X |

FOREIGN PATENT DOCUMENTS 2854096 6/1980 Fed. Rep. of Germany .

*Primary Examiner*—Edgar S. Burr
*Assistant Examiner*—Charles A. Pearson
*Attorney, Agent, or Firm*—Hill, Van Santen, Steadman & Simpson

[57] ABSTRACT

A push-button switch device for keyboards is provided with a multiple keyboard spanning several keys of the keyboard carrier plate and a support arrangement such that operation of the keybutton is balanced even though the key-button switch may be positioned asymmetrically with respect to the multiple button. The support arrangement includes a U-shaped guide bracket which is pivotally fastened on one side in the keybutton and on the other side over the carrier plate. A guide portion is positioned in a carrier plate recess adjacent to the key housing for the push-button switch and has the same shape as the key housing, enabling the guide portion to possibly be replaced by an actual key housing to rearrange the keybutton line-up in the keyboard. The end of the guide bracket adjacent the carrier plate is connected to a support piece which is slidably supported over the upper surface of the guide portion. A guide tongue extends beneath the keybutton through a guide aperture formed in the guide portion. This arrangement serves to align movement of the keybutton during activation of the push-button switch so that jamming of the push-button switch in a multiple button arrangement is prevented.

5 Claims, 3 Drawing Figures

PARALLEL GUIDE FOR PUSH-BUTTON SWITCHES WITH MULTIPLE BUTTONS

This application is a continuation of application Ser. No. 285,627, filed 7/21/81, now abandoned.

BACKGROUND OF THE INVENTION

The invention is directed to a push-button switch structure, particularly adapted for utilization in keyboards of typewriters and similar devices, and, more particularly, concerns a keybutton arrangement spanning several key locations fastened in a keyboard carrier plate.

German OS No. 2854096 illustrates a known construction for a push-button switch for a typewriter keyboard comprising a key housing portion locked into a respective recess of a keyboard carrier plate and a keybutton and associated striker element positioned for reciprocal movement in the key housing. Heretofore, if one wished to arrange a push-button switch with a keybutton spanning several key locations, hereinafter referred to as a multiple button, then it was customary to arrange the key housing and striker centrally of the multiple button. In cases where the multiple button was a double button spanning two key locations, the carrier plate and associated conductor plate of the keyboard were specially designed for the use of two push-button switches to operate simultaneously with a unitary, double button. If one attempted to arrange a multiple keyboard in such a manner that the associated switch was seated non-symmetrically of the multiple button, then the lopsided seating would tend to cause jamming of the switch and multiple button due to that portion of the multiple button projecting over the push-button switch.

An object of the present invention is to provide for a push-button switch beneath a multiple button without requiring the use of a plurality of push-button switches while, at the same time, avoiding a lopsided arrangement tending to jam the key button or push-button switch.

SUMMARY OF THE INVENTION

A push-button switch is arranged with at least one U-shaped guide bracket which fits underneath a keybutton. The bracket is pivotally mounted at opposed ends about two rotational axes in such a manner that the first axis is defined by hinge pins running longitudinally through the base portion of the bracket fastened in a support piece arranged over a carrier plate and the second axis is defined by hinge pins running through the outer, free ends of the bracket side legs fastened in the keybutton. The support piece is seated in a guide portion constructed in the manner of a key housing and contains a central opening for receiving a vertically extending guide tongue means connected to the key button. The guide portion is to be arranged in a carrier plate recess adjacent to the key housing for the push-button switch. In this manner, the carrier plate and conductor plate of a keyboard need not be specially modified to receive a multiple button arrangement. The carrier plate can be fitted with normal recesses and later, independently fitted with a varied keybutton line-up, including multiple buttons. The present invention makes the manufacture of keyboards significantly easier.

DESCRIPTION OF THE PREFERRED EMBODIMENT

Figure 2:
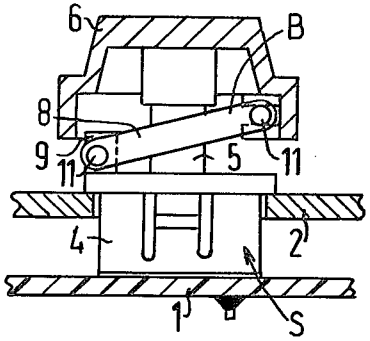
FIG. 2 is a schematic, side cross-sectional view of the multiple button and push-button switch arrangement of FIG. 1.
Figure 1:
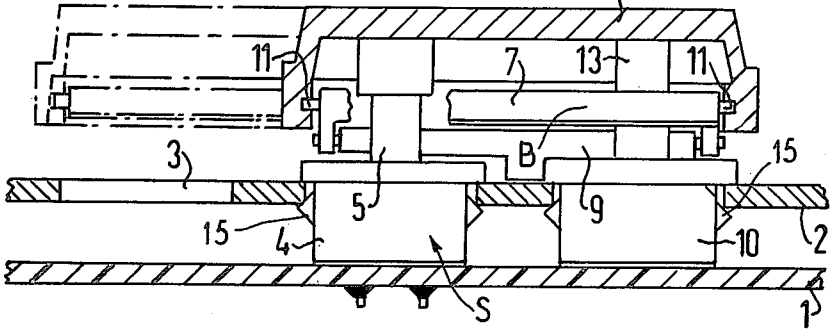
FIG. 1 is a schematic, broken-away, front cross-sectional view of a keyboard containing a multiple button and push-button switch constructed in accordance with the present invention.
Figure 3:
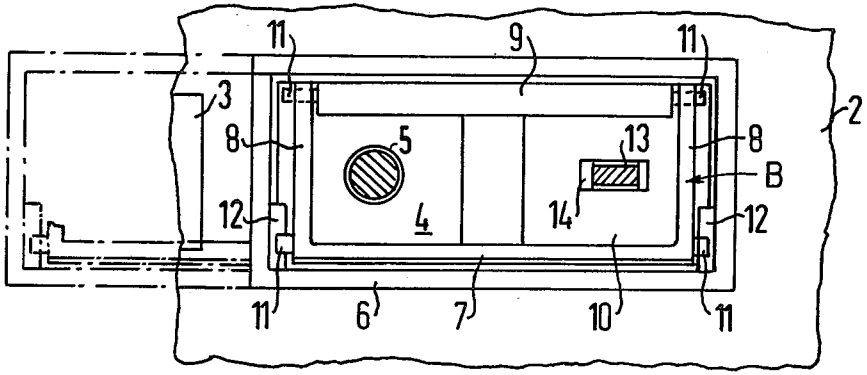
FIG. 3 is a schematic, top cross-sectional view of the multiple button and push-button switch arrangement of FIG. 1.

FIGS. 1–3 illustrate a teletypewriter keyboard having a conductor plate 1 in the form of a printed circuit board with appropriate wires arranged thereupon and a carrier plate 2 positioned over the conductor plate for receivingly suporting individual push-button switches. The carrier plate is formed with a series of generally square receiving apertures 3 for containing the individual push-button switches which are locked or soldered against the conductor plate 1.

A multiple button 6, shown in the solid line configuration as a double button, has a shell housing which is fastened to a key striker or tappet element 5 which is positioned in a key housing 4 for a push-button switch S. The striker 5 is mounted for reciprocal vertical movement within the key housing 4 and is biased by an opposing spring force (not shown) fitted in the key housing. The double button 6 is arranged non-symmetrically with respect to the key housing 4.

To prevent jamming of the multiple button during push-button switch actuation, a rectangular guide bracket means B is positioned between the multiple button 6 and the key housing 4. The bracket means B comprises a main portion with a U-shaped profile defined by a longitudinally extending base member 7 having a pair of spaced transversely directed legs 8 formed at opposed ends thereof and a cooperating auxiliary portion extending between the outer ends of legs 8. The guide bracket means is pivotally mounted via two rotational axes which run parallel to the longitudinal member 7. The first rotational axis is formed by the auxiliary portion, which can be a bar-like support piece 9 which is mounted over the carrier plate 2. A guide portion 10 having an exterior form similar to that of the key housing 4, is positioned within a recess 3 next adjacent to the key housing 4. The support piece 9 is slidably disposed over the upper surface of the guide portion 10. Opposed outer ends of the support bar 9 are formed with hinge pins 11 which cooperate with corresponding pin holes formed in the free ends of the transverse legs 8 for pivotal support of the guide bracket. The second rotational axis runs through the longitudinal member 7. Opposed ends of the longitudinal member are formed with further hinge pins 11 cooperatively received in respective guide slots 12 formed in the side surfaces of the housing shell of the keybutton 6 for pivotally supporting the bracket.

A vertically extending guide tongue means 13 is connected beneath the keybutton 6 and extends downward into a generally centrally located, guide aperture 14 formed in the guide portion 10. Accordingly, when the keybutton 6 is depressed, the striker 5 of the switch S and the guide tongue 13 mounted in the guide portion 10 move simultaneously in a balanced fashion. The guide bracket B further serves to align the button shell housing during its downward movement by cooperation of the bar 9 with a facing edge surface of the shell to prevent jamming of the button and the push-button switch.

Beveled stop elements 15 are provided on the key housing 4 and guide portion 10 to fasten these elements in the apertures 3 of the carrier plate 2.

The inventive arrangement makes possible replacement of the guide portion 10 with a further key housing for a push-button switch such that the line up of the keybuttons may be varied.

The present invention is not limited to double-type multiple buttons. For example, in the case of a triple button, indicated by the dotted line configuration shown in the drawings, the guide bracket B is appropriately lengthened such that the associated support bar 9 substantially spans three receiving apertures 3. By virtue of the guide bracket arrangement, jamming of the push-button switch and keybutton 6 is prevented without the need for a further guide portion 10 in the third aperture 3. The balanced arrangement prevents jamming even when the keybutton 6 is engaged adjacent its outer ends.

Although various minor modifications may be suggested by those versed in the art, it should be understood that I wish to embody within the scope of the patent warranted hereon all such modifications as reasonably and properly come within the scope of my contribution to the art.

I claim as my invention:

1. A key actuator apparatus for use in a keyboard carrier plate having at least one row of plural key apertures comprising a key housing mounted in a first key aperture and a vertically movable striker means positioned in said key housing, a guide portion shaped like said key housing and mounted in a second key aperture adjacent said first key aperture, a keybutton spanning plural key apertures connected at one opposed end onto said striker means and having at its other opposed end a vertical guide tongue for supportive receipt in said guide portion, and a rectangular guide bracket having one end pivotally mounted on a first pair of two spaced pins in said keybutton and the other end pivotally mounted on a second pair of two spaced pins on an auxiliary portion arranged on said guide portion, said auxiliary portion beng slidably disposed on an upper surface of said guide portion.

2. The apparatus of claim 1, wherein said guide tongue is received in a central aperture formed in said guide portion.

3. The apparatus of claim 1, wherein said guide bracket has a main portion with a U-shaped profile defined by a longitudinal base member and a pair of spaced legs extending outward therefrom, and said auxiliary portion extends between outer ends of said legs.

4. The apparatus of claim 3, wherein said second pair of spaced pins are formed on opposite ends of said auxiliary portion and are hingedly received in cooperating slots formed on said legs for defining a first axis of pivotable rotation parallel to said longitudinal base member and said first pair of spaced pins are formed on opposed ends of said base member and are hingedly received in cooperating slots formed on said keybutton for defining a second axis of pivotable rotation coaxial with said base member.

5. The apparatus of claim 4, wherein said auxiliary portion is a bar.

* * * * *